US005694698A

United States Patent [19]

Slates

[11] Patent Number: 5,694,698

[45] Date of Patent: Dec. 9, 1997

[54] ARCHERY BOW ADJUSTABLE SIGHTING DEVICE

[75] Inventor: Scott O. Slates, St. Charles, Mo.

[73] Assignee: Toxonics Manufacturing, Wentzville, Mo.

[21] Appl. No.: 566,947

[22] Filed: Dec. 4, 1995

[51] Int. Cl.[6] ..... F41G 1/467

[52] U.S. Cl. ..... 33/265; 124/87

[58] Field of Search ..... 33/265, 241; 124/87

[56] References Cited

U.S. PATENT DOCUMENTS

| | | | |
|---|---|---|---|
| 3,084,442 | 4/1963 | Jacobson et al. | 33/265 |
| 3,450,122 | 6/1969 | Diamond | 33/265 |
| 3,674,002 | 7/1972 | Diamond, Sr. | 33/265 |
| 3,693,262 | 9/1972 | Wood | 33/265 |
| 3,822,479 | 7/1974 | Kowalski | 33/265 |
| 4,020,560 | 5/1977 | Heck | 33/265 |
| 4,580,349 | 4/1986 | Webb et al. | 33/265 |
| 4,823,474 | 4/1989 | Reynolds | 33/265 |
| 5,384,966 | 1/1995 | Gibbs | 33/265 |
| 5,414,936 | 5/1995 | Sappington | 33/265 |

*Primary Examiner*—Thomas B. Will
*Attorney, Agent, or Firm*—Paul M. Denk

[57] ABSTRACT

A sighting device incorporating a sight for use with an archery bow, to facilitate accurate sighting on a target, the sighting device capable of shifting vertically with respect to its assembly, the assembly having a surface to either side, to which a marking surface is applied, and at least one indicator element provided upon the sight assembly and capable of shifting into one position to provide for scribing upon the marking surface, after a sighting distance has been set, with the sight assembly being adjustable to a different elevation, to provide for rescribing of the marking surface at another distance of sighting, whereupon the indicator element may be pivotally turned, a select degree, to position a pointer element that allows for ready readjustment of the sight, when the archer determines the distance of a shot, for prompt resetting by the archer of the sight during usage.

6 Claims, 2 Drawing Sheets

ARCHERY BOW ADJUSTABLE SIGHTING DEVICE

BACKGROUND OF THE INVENTION

This invention relates to an adjustable sighting device mounted on an archery bow to obtain the ability of recording the positions of the sighting device for various target distances that yields accuracy in hitting the approximate center of the target at each distance.

It is well known to provide an archery bow with a target sighting device that can be adjusted for obtaining accuracy in target and game shooting. The prior art can be divided into one class of sighting devices embodying one or more sighting pins or cross hair that can be adjusted for windage and gravitational effects. A second class of sighting devices is considerably complicated in that pin-type sighting devices have a plurality of sight pins which are not individually adjustable.

The prior art identified herein presents structure that is complicated due to a number of adjustments required in order to obtain a desired target alignment for both windage, gravitational effects, and other required adjustments, and when adjustments are made there is no simple provision for duplicating the sighting device when it is desired to make several distance sightings and then promptly return to repeat adjustment for any given sight reading.

SUMMARY OF THE INVENTION

A principal object of the invention is to provide an archery bow sighting device with any target sighting as selected that makes it simple to repeat a quick adjustment for distance whenever desired and required.

Another object of this invention is to provide upon an archery bow a sighting device capable of accepting manually applied markings for several target distance aimings so as to be able to promptly reset the sight for select distances.

A further object is to provide a bow sighting device with target distance's recordings according to a user of the bow for repetitive shooting results according to distances and gravitational effects.

Another object of the invention is to provide a bow sighting device for recording aiming results for either right hand or left hand archers.

Another object of this invention is to provide a bow sighting device that incorporates an adjustable locator element that can be set for providing a ready indication as to the elevation of the sight during shooting from particular distances, and can be finely adjusted through its manipulation depending upon the weight of the arrow or other accessories used during archery.

Other objects of the invention reside in the use of the sighting device having the preferred embodiments set forth in the several drawings' views.

DETAIL DESCRIPTION OF THE BOW SIGHTING DEVICE

Figure 1:
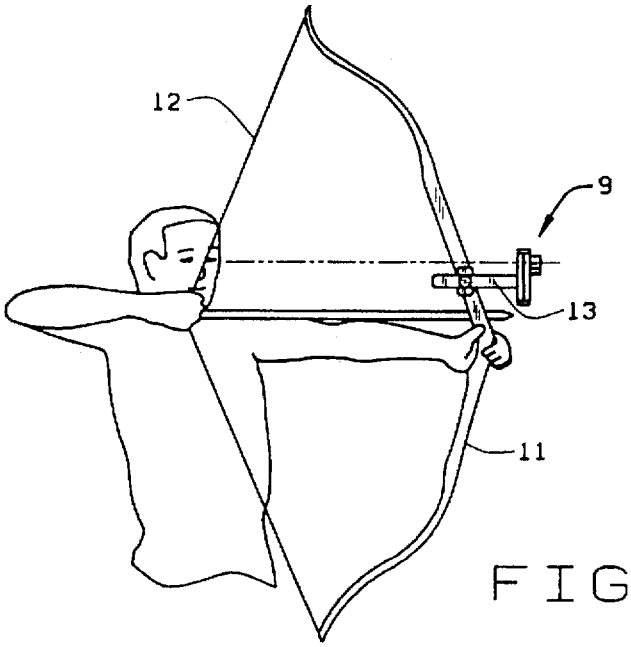
FIG. 1 is a schematic diagram of an archer applying a bow draw string in association with a bow equipped with a target sighting device to illustrate the environment of the invention.

The environment of the invention is depicted in FIG. 1 where the sighting assembly 9 is shown mounted on the bow 11 at a position above the archer's hand holding the bow while pulling or cocking the pull string 12.

Figure 2:
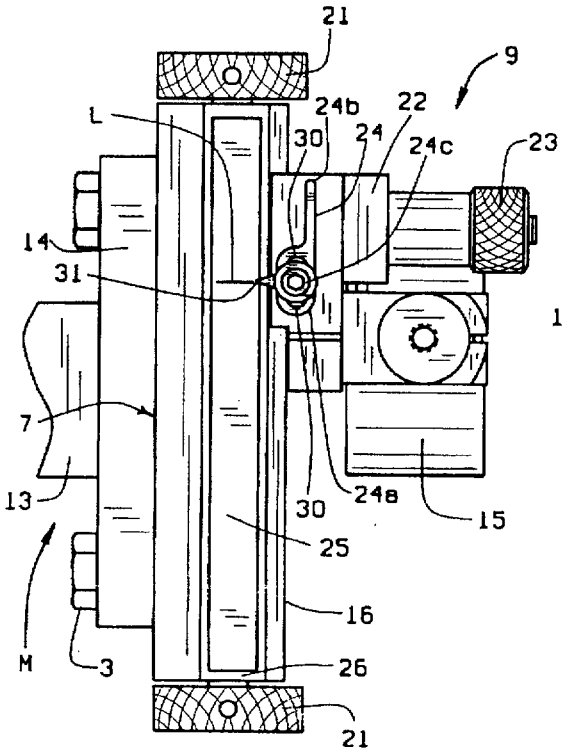
FIG. 2 is a vertical view of the sighting device to illustrate a first aspect of the invention.
Figure 3:
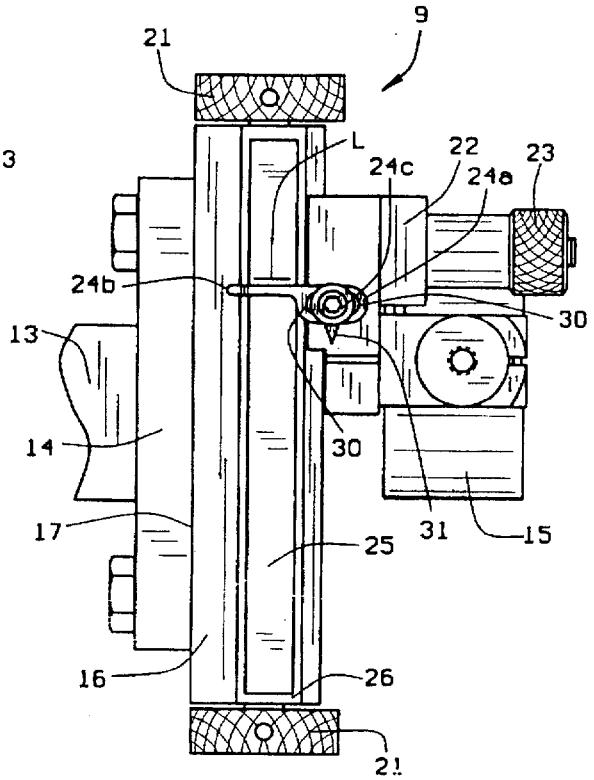
FIG. 3 is a further vertical view of the sighting device to illustrate another aspect of the invention.
Figure 4:
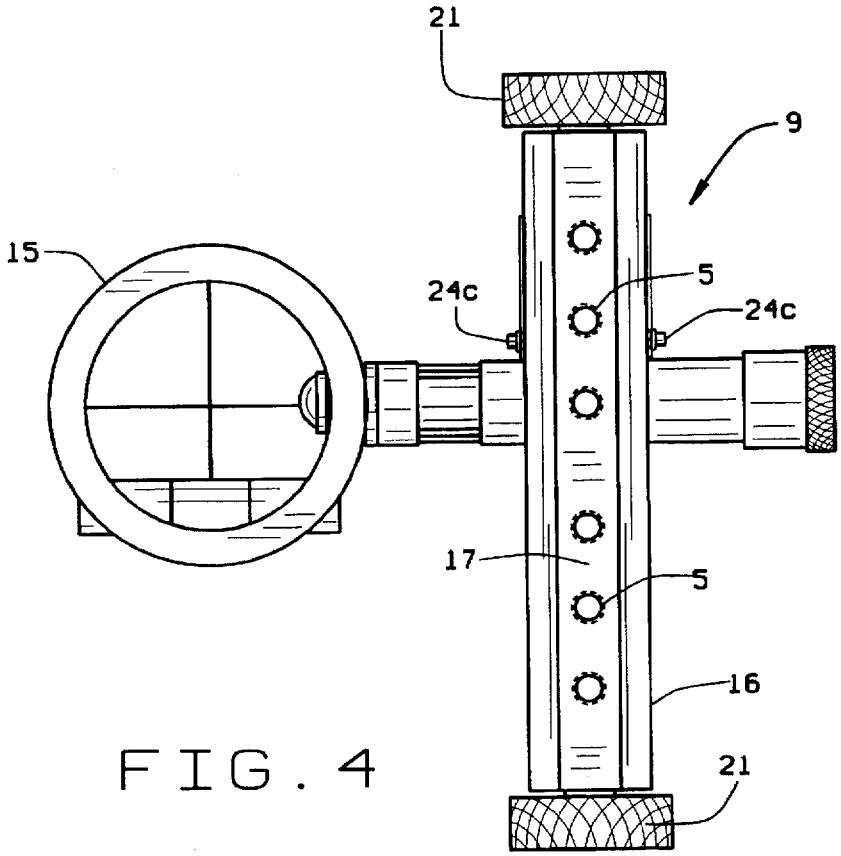
FIG. 4 is a vertical view of the sighting device in position to be attached to the supporting arm as viewed from the archer's position for a right handed archer.

The details of the device depicted in FIG. 1 are shown in an enlarged sketch of FIG. 2. As there shown the mounting arm 13, attached to the bow 11, provides a support to receive the sight assembly 9 for the device. The arm 13 attaches to the back 7 of the carriage 16. That assembly comprises a carriage 16 having a flat rear face 17 (FIG. 4) adapted to be bolted or otherwise secured to the mount M, as through the bolt 3, and select of the aligned threaded aperatures 5 (FIG. 4). The arm 13 also includes an arm means 14 through which the bolts 13 insert. The opposite face of the carriage 16 shows in FIG. 5 that it is hollow by being longitudinally slotted at 18 to receive and house an elongated screw shaft 19 mounted at its top and bottom ends in the fixed bushings 20 which are mounted in the slot 18. The knurled knobs 21 are fastened to the screw shaft 19, and turn therewith. Manual turning of either knob 21 rotates the shaft 19 in the carriage 16 to a selected position in which the assembly 9 for the sight frame 15 will reach an eye ball position to score a hit on a target. This is normally done through target practice. When that condition is reached to the satisfaction of the archer, the threaded shaft 19 can be fixed by actuating a lock knob 23 so a slide block 22 movable on its rails **22*a* fixes the sight in place. A locator element or guide 24 can be swung from its indicator position in FIG. 2 to a position adjacent a full length marking surface 25 on the lateral side face 26 of the carriage 16. The archer can apply a marking line "L" at the location on the surface 25 where a marking guide 24*b* on the locator element 24 aligns over that surface 25, as shown in FIG. 3. For example, once the archer has adjusted the sight to provide for bull's-eye shooting at and from a particular distance, and if he can guesstimate fairly accurately that particular distance, a line can be scribed through the use of a pencil, or pen, onto the surface 25. Surface 25 may be a paper applied tape, which provides ready indication as to where the sight should be set when a shot is to be made through use of the bow and arrow towards a target, at that particular gauged distance. If the archer, by further example, is approximately thirty (30) yards away from the target, and he has consistently shot arrows that enter the bull's-eye, at that particular marking, then that is the position where the sight mark line "L" should be set whenever a shot is to be made approximately from a thirty (30) yard distance. Then, if the archer backs up another ten (10) yards, the sight assembly 9 will need to be lowered some distance, to in effect raise the bow, to compensate for gravitational and other effects upon the arrow, and when that adjustment is finally made, and the sight adjusted to the new precise level of the marking guide 24*b*, another line may be scribed through the use of a writing instrument upon the surface of the indicator 25**, to indicate this is where the sight should be set when a shot is to be made from approximately a forty (40) yard distance, away from the target.

After a scribed mark on surface 25 has been made, the marking guide **24*b* can be pivoted to the position seen in FIG. 2. In that position the enlarged body 24*a* is seen to have an elongated slot 30 and a pointer element 31 (FIG. 2), which can be brought into alignment with the marking on surface 25 and secured by tightening a nut 24*c*. Similar type sightings can be made for other distances, whether it be from ten (10) to one hundred (100) yards, and related scribings can be made upon the indicator 25**, to provide quick indications as to where the sight is to be set, as soon as the archer determines his/her approximate distance from the target, in prompt preparation for shooting another arrow, particularly when hunting.

When several targets are to be sighted at different distances, the element or guide 24 can be pivoted to the position seen in FIG. 2 so the pointer 31 on the element 24 will project towards the previously scribed mark "L" on surface 25 as a quick finder and indicator of a previousy scribed line on the surface 25. The next target sighting procedure at a different distance can be sighted in by simply rotating either knobs 21 to turn the screw shaft 19 to elevate or lower the sight device 10 until an accurate position and elevation of the sight frame 15 has been determined through previous sight adjustment shootings of several arrows until an arrow scores a bull's-eye on a target (not shown) which can be recorded by scribing a corresponding line on the surface 25 where element **24*b* intersects the said surface 25**.

Figure 5:
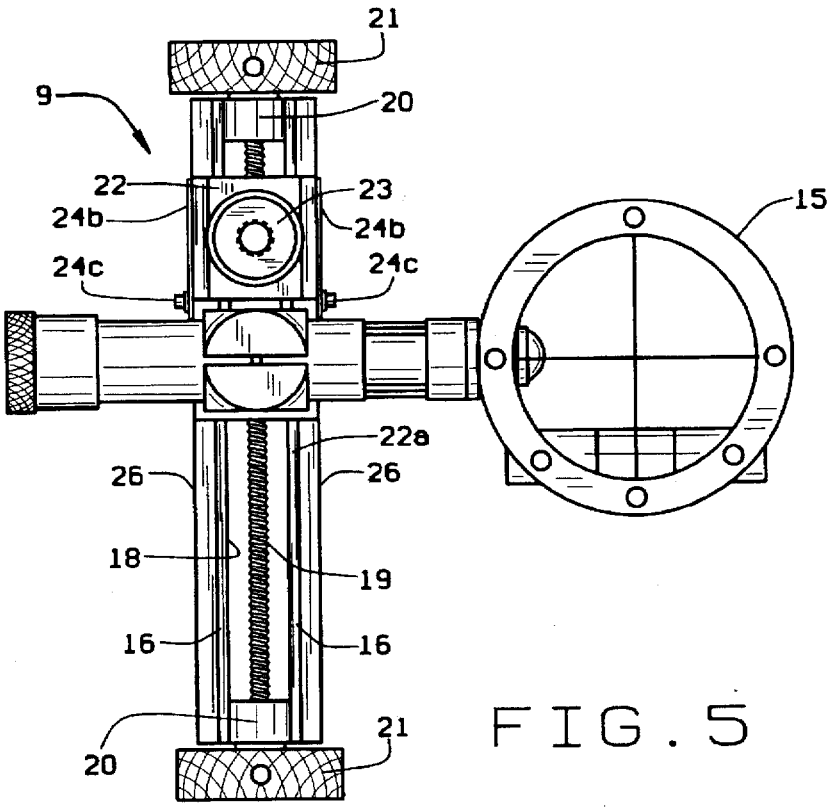
FIG. 5 is a vertical view of the sighting device opposite to the view of FIG. 4.

It is recognized that once a variety of target sighting markings have been properly gauged, and scribed upon the surface 25, the element guage marking guide 24 can be pivoted approximately 90°, through a loosening of its tightened Allen nut **24*c*, until such time as the pointer 31 comes into the position as shown in FIG. 2, to provide a ready indication when the sight has been elevated to the line L desired, upon the surface 25 as previously scribed. It should also be noted that opposite sides of the carriage 16 can be provided with another marking guide and an adjusting nut 24*c*, as can be seen in FIG. 5, so that markings may be scribed on either side of the carriage 16, and provide ample room for application of gauging distances, and markings, to readily indicate to the archer where the carriage 16** should be elevated to, or lowered, in order to provide a quick setting for prompt sighting by the archer, whether he/she be undertaking target practice, or shooting at game, as during hunting.

Another feature of this invention is that the locator element 24, where the threaded nut **24*c* extends through it, is provided with an elongated slot or aperture 30 so that the nut can be accommodated therethrough, and fasten the element 24 to and within the block 22. That aperture, as at 30, is elongated, as stated, so that the element or guide 27 can be slightly shifted, longitudinally of the carriage, with respect to the indication made by the pointer 24*a*, when set. Hence, when the locator element 27 is turned from a scribing position, as shown in FIG. 3, to a pointer or indicating position, as shown in FIG. 2, the locator element 27 may be slightly shifted, along its elongated slot 30, so as to provide for precise setting of the locator element, and its pointer 31. Another advantage to the positioning of the elongated slot at this location is that should the archer decide to use a different weight arrow, in shooting, than those that were used for establishing the positioning of the scribed lines during sighting, as at a particular set distance, he simply needs to sight in on the target, with the new weight arrow. For example, if a lighter weight or heavier weight arrow should be used, in lieu of the one that was shot when adjusting the scribed positions in the first instance, that different weight in arrow will disrupt the settings, for achieving accurate shooting at the previously scribed distances. Hence, for example, it will be necessary to achieve a resetting of the sight for the new arrow at one of the specified distances, for example, at the thirty (30) yard distance, the knurled knobs 21 will need to be turned, and the new weight arrow reshot, a number of times, until such time as a bulls'-eye is hit upon the target, consistently, with that weight arrow, at the readjusted position for the sight. Obviously, when that occurs, the pointer 31 will be either above or below the previously scribed thirty (30) yard mark set for the arrow used for the original target setting, at that distance. Hence, at that point, the tape may be removed, and shifted, to provide for the marked line at thirty (30) yards to be directly adjacent the tip of the pointer 31. Or, the Allen screw 24*c* can be loosened, and the indicator 24 can be shifted, a slight distance, until the pointer 31 points adjacent the previously scribed line, for the thirty (30) yard distance, the nut retightened, so that the precise setting for shooting of the different weight arrow, from that distance, will consistently come close or hit the bulls'-eye, as desired. When that occurs, all of the other previously scribed lines, for the other yardage distances, will already be set, for accurate shooting, with the different weight arrow, because of the previous settings made, and scribed, upon the surface 25**. Once the resetting of the accurate distance has been achieved, the archer will have accurate setting for any previously scribed distance, for future archery with an arrow of that change in weight.

Hence, the attributes of this invention, for providing a scribed line, a pivotal pointer, and yet an adjustable pointer through the arrangement of the elongated slot 30, provides for accurate and quick markings, depending upon the distance gauged for the weight of the arrow to be shot, all of which can be achieved through the efforts and usage of the adjustable sighting device of this invention.

The preferred embodiment of the invention shown in the several views of the drawings can be adapted for use by an archer who may be right handed or left handed by rotating the assembly to place the sighting device 10 on the side opposite that seen in FIG. 4. Thus, a second locator element 24 can be mounted on the opposite side of carriage 16 where a second similar marking surface 25 can be located. When the sighting device is interchangeable from side to side of the carriage, the device can be used by both right handed and left handed archers to increase the utility of the invention, and also provide ample surface area for providing multiple scribings.

Variations or modifications to the disclosed subject matter of the invention may occur to those skilled in the art. Such variations or modifications are intended to be included within the scope of the defined invention, and encompassed within claims of any patent issuing hereon.

Having thus described the invention, what is claimed and desired to be secured by Letters Patent is:

1. A sighting device incorporating a sight for use with an archery bow to facilitate accurate sighting on a target, the sighting device comprising:

a carriage operatively and rotatably supporting a screw shaft;

a sight and a sight support body engaged on said screw shaft so as to respond to screw shaft rotation for moving said sight and support body along said carriage;

an indicator element on said support body and positioned to move in a path along said carriage in response to rotation of said screw shaft which raises or lowers the sighting device;

a marking surface on said carriage adjacent the path of movement of said indicator element, said support body moving said indicator element into position for guiding the scribing of a selected position of said sighting device on said carriage marking surface; and said indicator element on said support body includes a marking guide movable over said marking surface for guiding the scribing of a marking line, and a pointer element on said marking guide to precisely locate said marking guide relative to said marking surface.

2. The sighting device set forth in claim 1 wherein said carriage supports said screw shaft for rotation in opposite directions to effect movement of said support body in opposite directions of displacement relative to said marking surface on said carriage.

3. The sighting device set forth in claim 1 where said support body having a pair of sight positions locating elements disposed on adjacent opposite sides of said carriage for locating said sight from opposite sides of said carriage, and an associated marking surface provided on each side of said carriage to accept multiple scribings for indicating many sight settings.

4. The sighting device as set forth in claim 1 wherein said indicator element incorporates an elongated slot, to provide for fine setting of said indicator element when readjustment of said sighting device is required.

5. A sighting device for an archery bow to embody target sighting markings for accuracy, the sighting device comprising:

a carriage to be attached to the archery bow, said carriage having a marking surface thereon to retain sighting markings recording accuracy in sighting targets;

a sight and a sight supporting body operatively associated on said carriage said sight and supporting body capable of moving along said carriage;

a marking guide carded on said supporting body adjacent said marking surface, said marking guide having a body formed with an elongated slot therein and an elongated marking area, said elongated slot and marking area being elongated in the same direction on said marking guide;

a pointer on said body projecting at right angles to said elongated slot and said marking area; and securing means releasably engaged in said elongated slot for holding said elongated slot and marking area selectively for a first position, with said marking area extending over said marking surface, and in a second position with said marking area retracted from said marking surface and said pointer directed towards said marking surface.

6. The sighting device set forth in claim 5 wherein said securing means released from engagement within said elongated slot allowing the direction of pointing of said pointer toward said marking surface to be varied.

* * * * *

UNITED STATES PATENT AND TRADEMARK OFFICE

CERTIFICATE OF CORRECTION

PATENT NO. : 5,694,698

DATED : December 9, 1997

INVENTOR(S) : Scott O. Slates

It is certified that error appears in the above-indentified patent and that said Letters Patent is hereby corrected as shown below:

Column 6, line 4, change "carded" to ---carried---.

On the title page, item [73], after "Manufacturing," please insert ---Inc.---.

Signed and Sealed this

Third Day of March, 1998

*Attest:*

*Attesting Officer*

BRUCE LEHMAN

*Commissioner of Patents and Trademarks*